United States Patent [19]

Christine

[11] Patent Number: 4,711,373

[45] Date of Patent: Dec. 8, 1987

[54] PORTABLE DISPENSING SYSTEM

[75] Inventor: William C. Christine, Catasauqua, Pa.

[73] Assignee: Trinity Foundation, Nazareth, Pa.

[21] Appl. No.: 869,341

[22] Filed: Jun. 2, 1986

Related U.S. Application Data

[63] Continuation-in-part of Ser. No. 850,034, Apr. 10, 1986, abandoned.

[51] Int. Cl.[4] ..... B65D 85/72; G01F 11/00

[52] U.S. Cl. ..... 222/82; 222/95; 222/105; 222/327; 222/386.5; 222/496

[58] Field of Search ..... 222/92, 95, 96, 105, 222/107, 183, 325–327, 213, 545, 490, 491, 494, 495, 496, 214, 335, 380, 387, 511, 512, 80–83, 497; 137/844, 852, 853, 857, 847; 251/4, 5, 7; 383/107, 121

[56] References Cited

U.S. PATENT DOCUMENTS

| | | | |
|---|---|---|---|
| 2,244,071 | 6/1941 | Landrus | 222/83 |
| 2,331,078 | 10/1943 | Peak | 222/490 |
| 2,657,829 | 11/1953 | Walch | 222/496 X |
| 2,659,517 | 11/1953 | Reinhardt, Jr. | 222/82 |
| 2,782,598 | 2/1957 | Gatwood | 60/52 |
| 2,947,448 | 8/1960 | Maddux | 222/494 X |
| 3,157,360 | 11/1964 | Heard | 222/214 X |
| 3,184,121 | 5/1965 | Volckening | 222/213 |
| 3,323,682 | 6/1967 | Creighton, Jr. et al. | 222/105 X |
| 3,338,478 | 8/1967 | Hedblad | 222/387 X |
| 3,381,886 | 5/1968 | Goglio | 383/121 |
| 3,884,396 | 5/1975 | Gordon et al. | 222/327 |
| 3,998,364 | 12/1976 | Hollander | 222/511 |
| 4,124,150 | 11/1978 | Moss | 222/494 |
| 4,163,509 | 8/1979 | Amneus | 222/494 X |
| 4,198,756 | 4/1980 | Dragan | 222/326 |
| 4,373,646 | 2/1983 | MacEwen | 222/327 |
| 4,432,473 | 2/1984 | MacEwen | 222/327 |
| 4,452,378 | 6/1984 | Christine | 222/107 |

*Primary Examiner*—Joseph J. Rolla
*Assistant Examiner*—Kevin P. Shaver
*Attorney, Agent, or Firm*—Seidel, Gonda, Goldhammer & Abbott

[57] ABSTRACT

A portable dispensing system includes a hollow body having two ends. A head is removably mounted on one end of the body and has an opening therethrough. A piston mechanism is removably mounted at the other end of the body. A valve mechanism for opening in response to pressure created by the piston mechanism is mounted on the head adjacent the opening. The valve mechanism includes a casing, a jaw slidably mounted on the casing for movement between an opened and closed position, and a spring mechanism urging the jaw to the closed position and yielding to pressure increases in the body. A flexible pouch is provided for receipt in the body. The pouch includes a main body made of a flexible material and a discharge portion which is integral with the main body. The discharge portion is capable of passing through the opening of the head and is for engagement with the jaw. Preferably, the pouch is fitmentless.

7 Claims, 5 Drawing Figures

PORTABLE DISPENSING SYSTEM

BACKGROUND OF THE INVENTION

The present invention is a continuation in part of patent application Ser. No. 06/850,034 for a Packaging and Portable Dispensing System filed Apr. 10, 1986, now abandoned in favor of copending continuation Application Ser. No. 023,937 filed Mar. 5, 1987.

FIELD OF THE INVENTION

The present invention relates to a dispensing system which includes a pouch having product therein to be dispensed, and wherein the dispensing system includes a pouch that does not have a fitment. The pouch includes a main body portion which is made of a suitable material such as a flexible plastic material, and the pouch has a discharge tube. Spring loaded or elastomeric jaws are provided on the dispenser so that such jaws function as a valve sealing the end of the tubular section of the pouch.

DISCLOSURE OF THE PRIOR ART

Heretofore, various methods and apparatus have been provided for dispensing material, as for example as shown in prior U.S. Pat. Nos. 2,782,598; 3,884,396; 4,198,756; 4,373,646; and 4,432,473. However, it is submitted that neither these patents nor any other patents known to the Applicant achieve the advantages and improvements that the present invention achieves or accomplishes.

BACKGROUND AND SUMMARY OF THE INVENTION

The present invention is directed to a dispensing system which features a pouch without a fitment. In other words, there is provided a fitmentless packaging dispenser wherein evacuation of the pouch can be readily accomplished in the most advantageous manner.

An object of the present invention is to provide a portable packaging dispensing system which is efficient to use, practical in its application, and economical to manufacture and utilize.

Further objects of the present invention will appear in the following description.

DESCRIPTION OF THE PREFERRED EMBODIMENT

Figures 1, 2, 3, 4, 5:
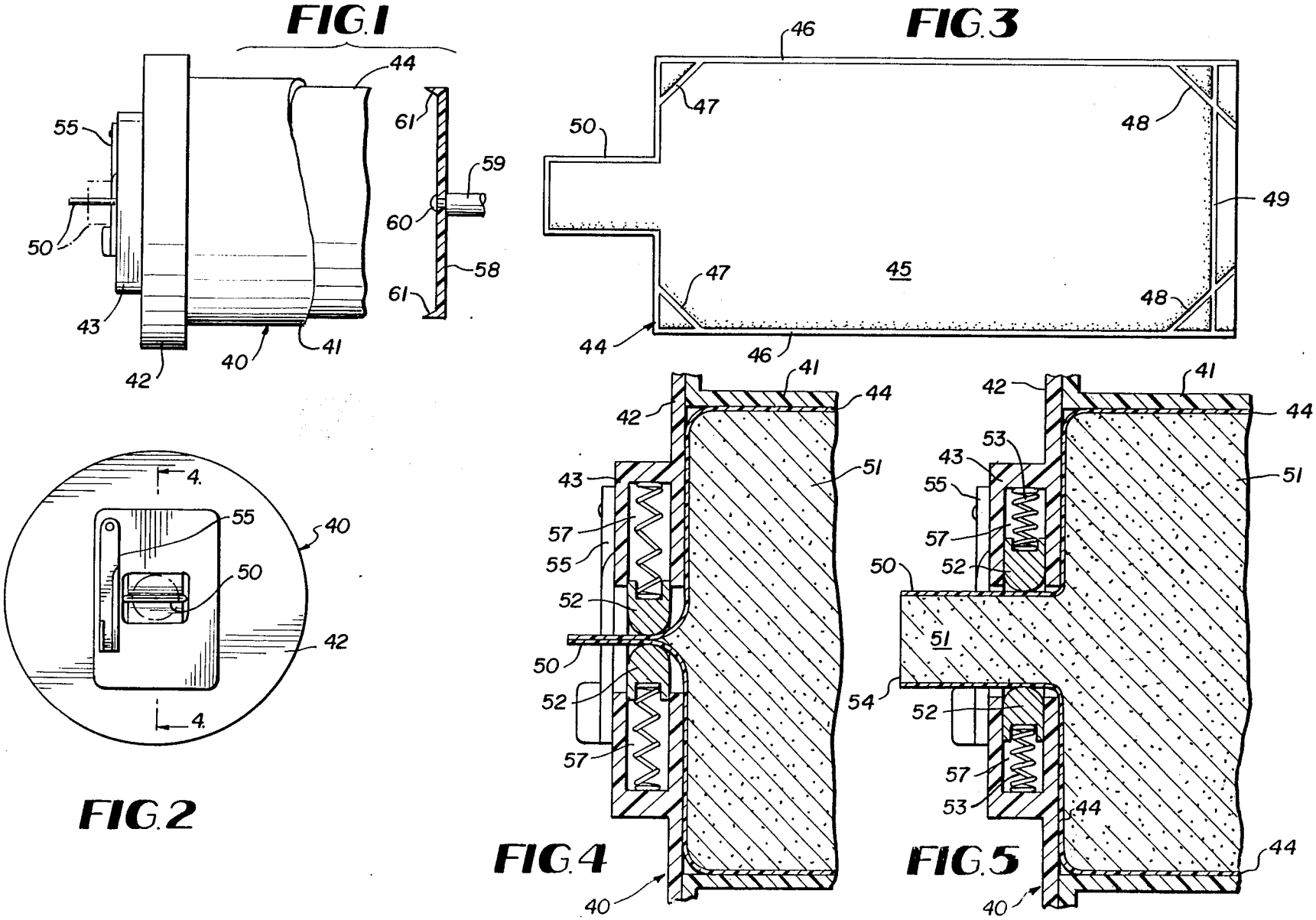
FIG. 1 is a fragmentary side elevational view illustrating the present invention.
FIG. 2 is an end elevational view of the arrangement shown in FIG. 1.
FIG. 3 is a side elevational view illustrating the fitmentless pouch.
FIG. 4 is an enlarged sectional view taken on the line 4—4 of FIG. 2.
FIG. 5 is a view generally similar to FIG. 4 but illustrating the discharge tube portion of the pouch in open position rather than closed position.

Referring now in detail to the drawings, the numeral 40 indicates a portable dispenser that includes a cylinder 41, and a removable head 42 mounted on the cylinder 40 as shown in FIG. 1. The numeral 43 indicates an enlargement or casing on the head 42 for a purpose to be later described.

As shown in FIG. 3, there is provided a fitmentless pouch 44 which is adapted to be made of a suitable material such as a flexible plastic material, and the pouch 44 includes a main body portion 45, side edges 46, chevrons 47 and 48 that define the seams, and a discharge tube portion 50. The pouch 44 further includes a closed end portion 49.

The numeral 51 in FIGS. 4 and 5 indicates the material in the pouch 44 that is to be dispensed, and there is provided spring loaded or elastomeric jaws 52 which act as a valve sealing the end of the tubular section 50 of the pouch 44. The jaws 52 are moveably mounted in chambers or spaces 57 in the casing 43, and springs 53 can be provided for biasing or urging the jaws 52 into closed position with respect to the tubular portion 50. The open end of the tube is indicated by the numeral 54 in FIG. 5 when pressure is applied to the dispenser as for example by means of a piston 58 which can be actuated by a rod 59 which is connected to the piston 58 by means of a securing element 60. The specific details of the piston 58 may be as shown in prior Patent Application Ser. No. 06/850,034 for a Packaging and Portable Dispensing System filed Apr. 10, 1986. The piston 58 may have inclined edges 61.

It will be understood that the parts can be made of any suitable mateial and in different shapes or sizes as desired or required.

From the foregoing, it will be seen that there has been provided a portable dispensing system and wherein the present invention is especially directed to the concept of a pouch such as the pouch 44 without a fitment. Thus, there is provided a fitmentless version of the subject matter shown in the prior Patent Application Ser. No. 06/850,034 for a Packaging and Portable Dispensing System filed Apr. 10, 1986.

FIG. 3 illustreates the flat pouch with the discharge tube 50. The dimensions can be varied as desired or required. The device includes an openable end or head 42 as well as a cylinder 41 and a piston 58. A cutoff knife 55 can be provided, and in FIG. 1 there is illustrated the discharge tube 50. The pouch 44 has the product 51 therein as shown in FIGS. 4 and 5. FIG. 4 illustrates the discharge tube in closed position, whereas FIG. 5 illustrates the parts in open position. That is, when pressure is applied by means of the piston 58, the product 51 is forced through the discharge tube 50 so as to cause the plungers 52 to compress the springs 53. The jaws or plungers 52 may be spring loaded as at 53, or they may be in the form of elastomeric jaws which act as a valve sealing the end of the tubular section 50 of the pouch 44.

The embodiment of the invention illustrated and described above is given by way of example only and is not intended to restrict the true spirit and scope of the invention as expressed in the appended claims.

I claim:

1. A portable dispensing system comprises:

a hollow body having a first and second open end, said hollow body receiving a flexible pouch comprising a main body made of a flexible material and a flexible discharge portion integral with said main body, said pouch being filled with a flowable material;

a head removably mounted at said first end of said body and having an opening therethrough;

piston means mounted at said second end of said body for applying pressure to the flowable material in said pouch;

said head including valve means adapted for opening in response to pressure created by said piston means acting on said flowable material in said pouch means, said valve means being mounted on said head adjacent said opening and comprising a casing, jaw means movably mounted on said casing for reciprocable movement between opened and closed positions, said discharge portion of the pouch passing through said opening of said head and being engaged by said jaw means, biasing means normally urging said jaw means to the closed position thereby closing said pouch and said biasing means yielding due to pressure increases on said pouch by said piston for the discharging of said flowable material.

2. The portable dispensing system according to claim 1 wherein a knife means is mounted on said casing.

3. The portable dispensing system according to claim 1 wherein said jaw means is slidable in a direction perpendicular to said opening.

4. The portable dispensing system according to claim 1 wherein said jaw means is slidable between said opened and closed positions.

5. The portable dispensing system according to claim 1 wherein said jaw means further comprises:

two opposed jaws slidably mounted in said casing for movement between opened and closed positions; and said biasing means being associated with each said two opposed jaws.

6. The portable dispensing system according to claim 1 wherein said pouch means is fitmentless.

7. A portable dispensing system for condiments and the like comprises:

a hollow body having a first and a second open end, said hollow body receiving a flexible pouch comprising a main body made of a flexible material and a flexible discharge portion integral with said main body, said pouch being filled with a flowable material;

a head removably mounted at said first end of said body and having an opening therethrough;

piston means mounted at said second end of said body for applying pressure to the flowable material in said pouch;

said head including valve means adapted for opening in response to pressure created by said piston means acting on said flowable material in said pouch, said valve means being mounted on said head adjacent said opening and comprising a casing, two opposed jaws mounted in said casing for sliding movement which is perpendicular to said opening and for movement between opened and closed positions, said discharge portion of the pouch passing through said opening of said head and being engaged by said jaws, biasing means associated with each said jaw and normally urging said jaws to said closed position and yielding due to pressure increases in said pouch by said piston for the discharging of said flowable material.

* * * * *